US007322487B1

(12) United States Patent
Hill

(10) Patent No.: US 7,322,487 B1
(45) Date of Patent: Jan. 29, 2008

(54) PROPANE TANK COVER

(76) Inventor: Frederick Hill, P.O. Box 575, Warrenville, IL (US) 60555

( * ) Notice: Subject to any disclaimer, the term of this patent is extended or adjusted under 35 U.S.C. 154(b) by 774 days.

(21) Appl. No.: 10/888,673

(22) Filed: Jul. 9, 2004

(51) Int. Cl.
*F17C 1/00* (2006.01)

(52) U.S. Cl. ..... 220/581; 220/724; 150/154

(58) Field of Classification Search ..... 220/581, 220/582, 724, 725; 206/0.6, 446; 150/154
See application file for complete search history.

(56) References Cited

U.S. PATENT DOCUMENTS 4,964,529 A 10/1990 Houston ..... 220/402
6,012,411 A 1/2000 Hochbrueckner ..... 116/207
6,123,187 A * 9/2000 Bartels ..... 206/0.6
6,508,282 B2 1/2003 Garofalo ..... 150/154
D525,792 S * 8/2006 Leighton ..... D3/316

* cited by examiner

*Primary Examiner*—Anthony D. Stashick
*Assistant Examiner*—Harry A Grosso
(74) *Attorney, Agent, or Firm*—Goldstein Law Offices P.C.

(57) ABSTRACT

A propane tank cover, which safely covers, protects, and locks a propane tank having a protective cage. The propane tank cover has a protective cover, a safety cover, a tabletop, and a tablecloth for use as an end table. The safety cover has an upper circular plate having an outer edge for covering the protective cage, and a lower locking collar for fitting around the protective cage. The tabletop has a bottom surface having a centrally positioned track having a slotted channel. The slotted channel receives the outer edge of the upper circular plate for securing the tabletop to the safety cover and propane tank. The tablecloth is draped over the tabletop for fully covering the tabletop, safety cover, and propane tank.

11 Claims, 3 Drawing Sheets

PROPANE TANK COVER

BACKGROUND OF THE INVENTION

The invention relates to a propane tank, and more particularly, to a propane tank cover, which safely covers, protects, and locks the propane tank for use as an end table.

The warmth of the summer season makes it the perfect time of year to indulge in all manners of outdoor activities. From playing a spirited game of volleyball or lounging on the beach, to picnicking in the park or embarking on a camping adventure, people seek a myriad of ways to bask in this season's pleasantly balmy days and evenings. Perhaps a favorite summer pastime is enjoying a delicious meal prepared on a backyard grill. Whether planning a graduation party, a family get together or a weekend with friends, there is nothing like the ease of an outdoor barbeque to celebrate the arrival of summer.

When cooking on a barbeque, many prefer to use convenient charcoal grills for their preparation needs. However, in recent years more and more outdoor cooks are turning to the more efficient models operated by natural gas and propane. Not only do these gas grills light much faster, but they also allow the food to cook at a more consistent temperature while maintaining its natural flavor, without leaving a heavy charcoal taste. Some of the easiest grills to use, propane models are offered with an attachable tank, which contains the gas that fuels the fire of the grill. Ensuring that there is enough fuel whenever an impromptu barbeque is the plan for the day, many propane grill owners will keep a spare tank at the ready.

U.S. Pat. No. 4,964,529 to Houston discloses a container suited to enclose a gas tank and protect it from corrosion and handling. U.S. Pat. No. 6,102,411 to Hockbrueckner discloses a propane tank covering device comprised of a flexible material. U.S. Pat. No. 6,508,282 to Garofalo discloses an additional covering device for a propane tank.

While these units may be suitable for the particular purpose employed, or for general use, they would not be as suitable for the purposes of the present invention as disclosed hereafter.

SUMMARY OF THE INVENTION

It is an object of the invention to produce a propane tank covering device, which safely cover, protects, and locks a propane tank. Accordingly, the propane tank cover of the invention has a safety cover having an upper circular plate for covering, protecting, and locking a propane tank.

It is another object of the invention to provide a propane tank cover that can be used as an end table. Accordingly, the propane tank cover of the invention has a tabletop having a centrally positioned track having a slotted channel for receiving the upper circular plate of the safety cover for allowing the propane tank cover to double as an end table.

It is another object of the invention to provide a propane tank cover that is capable of being stored without being susceptible to weathering. Accordingly, the propane tank cover includes a waterproof tablecloth, which drapes over the tabletop for fully covering and protecting the tabletop, safety cover, and propane tank from weathering.

This invention is a propane tank cover, which safely covers, protects, and locks a propane tank having a protective cage. The propane tank cover has a protective cover, a safety cover, a tabletop, and a tablecloth for use as an end table. The safety cover has an upper circular plate having an outer edge for covering the protective cage, and a lower locking collar for fitting around the protective cage. The tabletop has a bottom surface having a centrally positioned track having a slotted channel. The slotted channel receives the outer edge of the upper circular plate for securing the tabletop to the safety cover and propane tank. The tablecloth is draped over the tabletop for fully covering the tabletop, safety cover, and propane tank.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
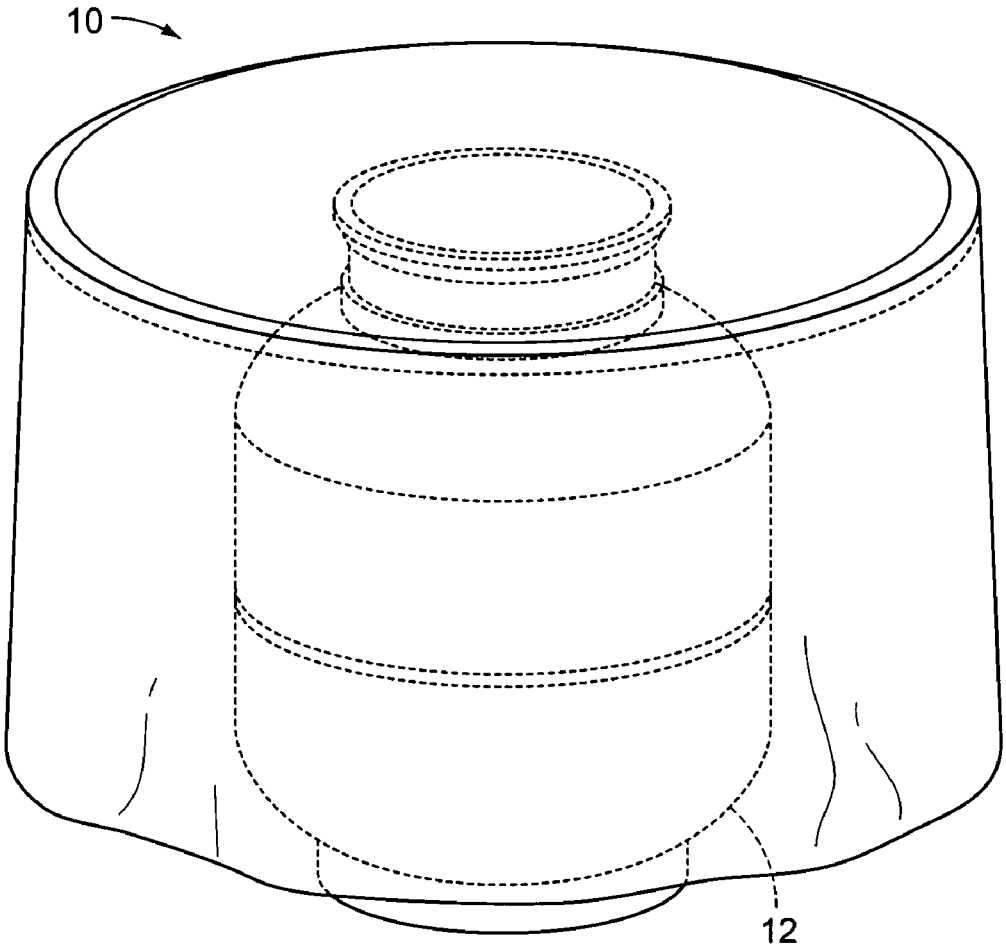
FIG. 1 is a diagrammatic perspective view of the propane tank cover of the invention for use locking, protecting, and covering a propane tank.

FIG. 1 illustrates a propane tank cover 10, which safely covers, protects, and locks a propane tank 12. In its broadest context, the propane tank cover 10 includes a safety cover, a tabletop, and a tablecloth for use as an end table.

Figure 2:
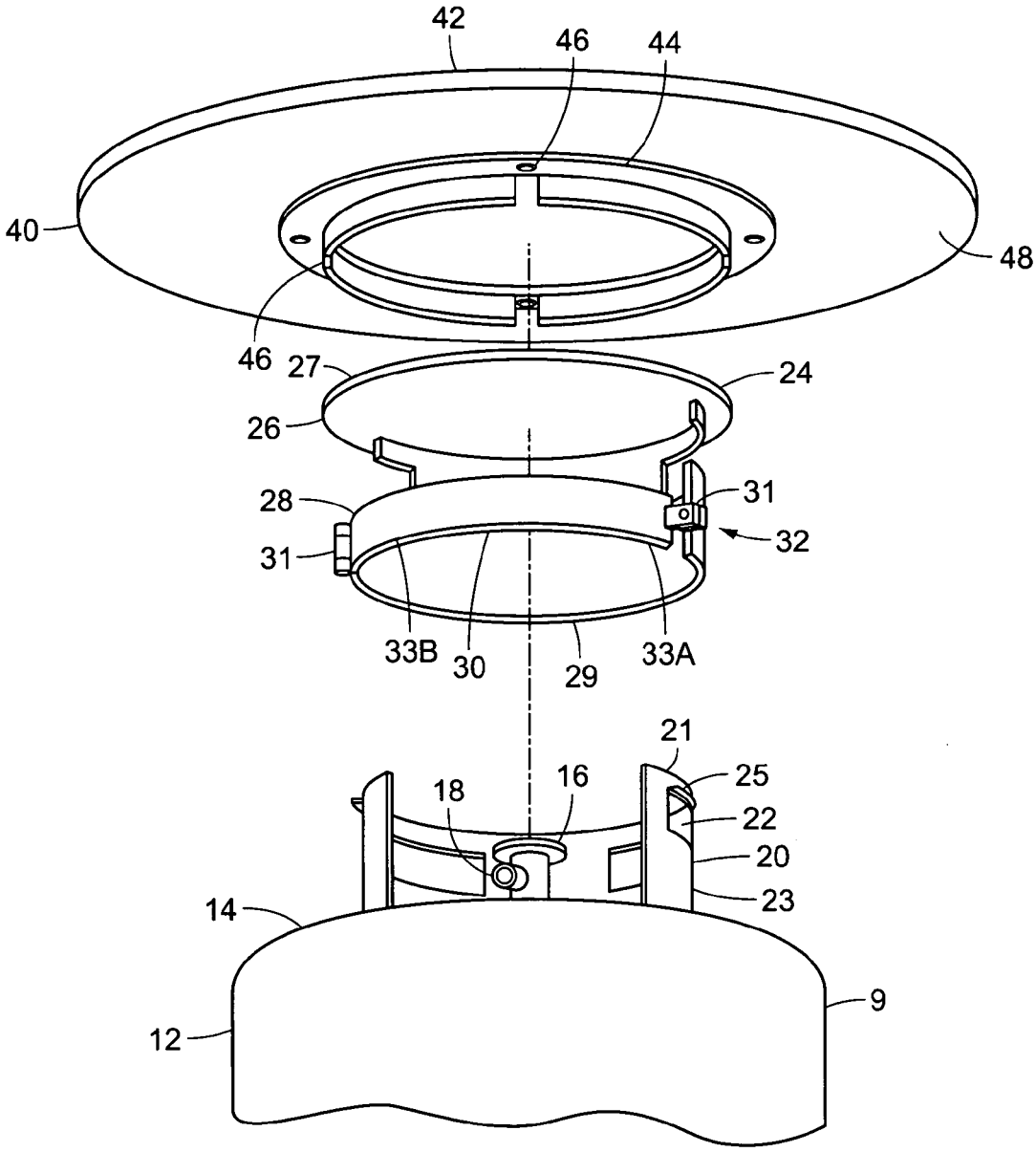
FIG. 2 is an exploded view of the propane tank cover, including the propane tank, a safety cover and a lid.
Figure 3:
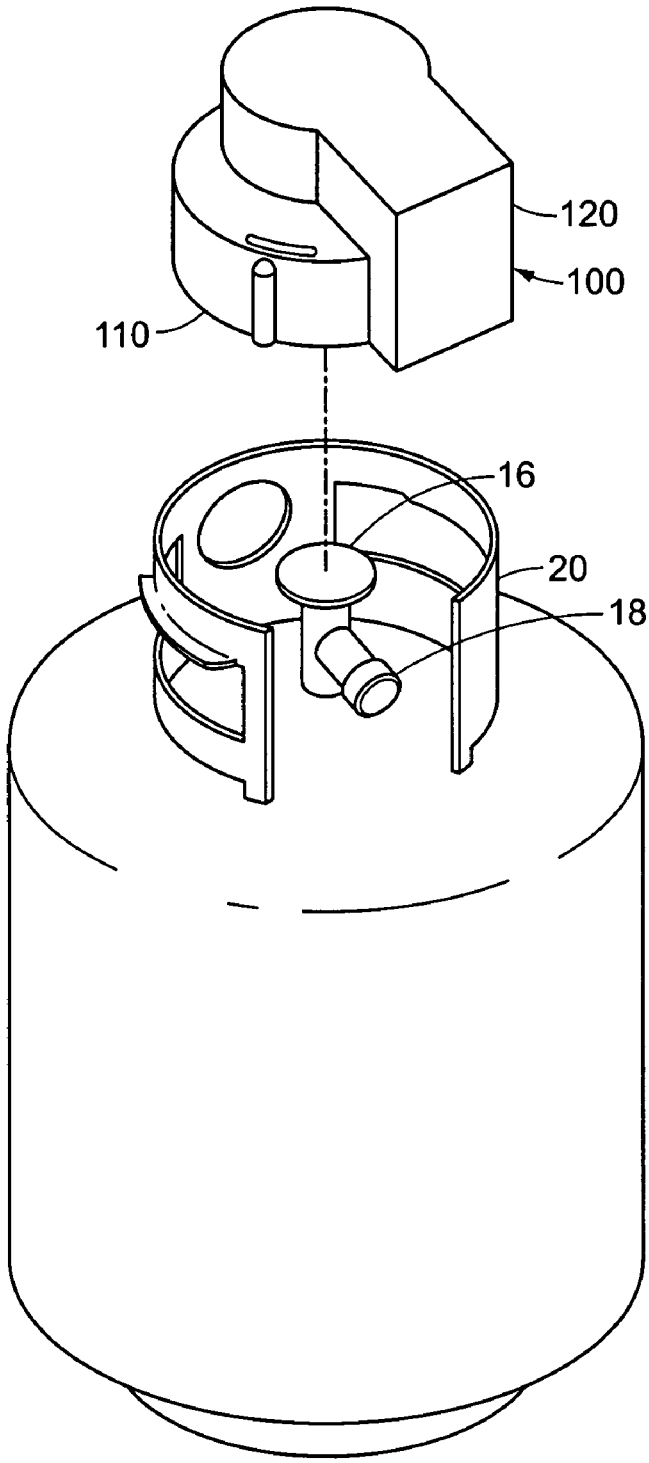
FIG. 3 is a diagrammatic perspective of a protective cap of the invention.

FIG. 2 illustrates the propane tank 12, having a cylindrical body 9 with an upper spherical cap 14. Extending upwardly from the upper spherical cap 14 is a valve structure 16. The valve structure 16 has a side port 18. A protective cage 20 surrounds the valve structure 16, leaving access to the side port 18. The protective cage 20 thus surrounds approximately three quarters of the valve structure 16. The protective cage 20 has an upper edge 21 and a lower portion 23. The protective cage 20 has at least one opening 22, which serves as a handle for manually carrying the propane tank 12. In some instances, the propane tank 12 may include a lip 25 extending outwardly from the opening 22, for more comfortably carrying the propane tank 12. A protective cap 100, illustrated in FIG. 3, conforms within the protective cage 20 for safely covering the valve structure 16 when not in use. The protective cap 100 includes a base portion 110 which fits within the protective cage 20. The protective cap also includes an L-shaped member 120 which is attached onto the base portion 110 and extends over the side port 18 for protecting the side port 18 from leakage when not in use.

The safety cover 24 conforms to the protective cage 20 of the propane tank 12. Preferably, the safety cover 24 is metal. The safety cover 24 defines a cylindrical frame and has an upper circular plate 26 and a lower locking collar 28. The upper circular plate 26 has an outer edge 27 and is preferably 7 inches in diameter. The lower locking collar 28 has a fixed member 29, a rotatably hinged member 30, and a locking mechanism 32. The rotatably hinged member 30 has a first and a second end 33A and 33B and is attached at the first end 33A to the fixed member 29 by a hinge 31. The safety cover 24 is slipped over the protective cage 20 of the propane tank 12. The upper circular plate 26 is used to cover the protective cage 20 and the valve structure 16 by resting over the upper edge 21 of the protective cage 20. The lower locking collar 28 is fitted around the lower portion 23 of the protective cage 20 near the upper spherical cap 14. The rotatably hinged member 30 of the lower collar 26 is open and used to slipping the safety cover 24 over the propane tank 12 having the outwardly extending lip 25. Otherwise the lip 25 would prohibit the lower locking collar 28 from slipping over the protective cage 20. Once the safety cover 24 is in position covering the protective cage 20, the rotatably hinged member 30 is securely closed against the fixed member 29 at the second end 33B by the locking mechanism 32. The locking mechanism 32 can be a clamp, for holding the lower locking collar 28 in place. In other embodiments, both the fixed member 29 and the rotatably hinged member 30 can have aligned cutouts when closed, for allowing a pad lock to secure the lower locking collar 28 around the lower portion 23 of the protective cage 20.

The tabletop 40 of the propane tank cover 10 is a circular lid for attaching to the upper circular plate 26 of the safety cover 24. Preferably, the tabletop 40 is plastic, wood, or metal, measuring 14 inches in diameter. However, in other embodiments, the tabletop 40 may be square or rectangular in shape. The tabletop has a top surface 41 and a bottom surface 42. The bottom surface 42 has a centrally positioned track 44 attached thereto by a plurality of screws 46. The track 44 extends outwardly from the bottom surface 42 preferably 4 inches, and is preferably 7⅜ inches circular in diameter. The track 44 is therefore slightly larger in diameter from the upper circular plate 26. The tract 44 includes a slotted channel 46. The slotted channel 46 receives the outer edge 27 of the upper circular plate 26 and thereby secured the tabletop 40 to the safety cover 24 and propane tank 12.

The tablecloth 48 is draped over the top surface 41 of the tabletop 40. The tablecloth 48 is preferably circular in size and 48 inches in diameter for fully covering and protecting the tabletop 40, safety cover 24, and propane tank 12 from weathering. The tablecloth 48 is preferably waterproof and made in a variety of colorful prints to appeal to a variety of tastes.

The propane tank cover 10 is therefore used as an end table for covering the propane tank 12 therebelow. The tabletop 40 is used for playing board or card games, as a surface for placing food while cooking or eating outside, or as a pedestal for potted plants or flower vases.

In conclusion, herein is presented a propane tank cover. The invention is illustrated by example in the drawing figures, and throughout the written description. It should be understood that numerous variations are possible, while adhering to the inventive concept. Such variations are contemplated as being a part of the present invention.

What is claimed is:

1. A propane tank cover, which safely covers, protects, and locks a propane tank, the propane tank having a cylindrical body with an upper spherical cap, having a valve structure extending upwardly from the upper spherical cap, the valve structure having a side port, having a protective cage surrounding the valve structure, leaving access to the side port, the protective cage having an upper edge and a lower portion, and the protective cage having at least one opening having a lip extending outwardly therefrom for manually carrying the propane tank, comprising:

a safety cover conforming to the protective cage of the propane tank defining a cylindrical frame, having an upper circular plate and a lower locking collar, the upper circular plate having an outer edge, the lower locking collar having a fixed member, a rotatably hinged member, and a locking mechanism, the rotatably hinged member having a first and a second end and being attached at the first end to the fixed member by a hinge, the safety cover being slipped over the protective cage, wherein the upper circular plate covers the protective cage and the valve structure by resting over the upper edge of the protective cage, and the lower locking collar being fitted around the lower portion of the protective cage near the upper spherical cap, the rotatably hinged member being securely closed against the fixed member at the second end by the locking mechanism;

a protective cap having a base portion and an L-shaped member, the base portion fits within the protective cage, while the L-shaped member attaches onto the base portion and extends over the side port for protecting the side port from leakage when not in use;

a tabletop for attaching to the upper circular plate of the safety cover, having a top surface and a bottom surface, the bottom surface having a centrally positioned track attached thereto by a plurality of screws, the track extends outwardly from the bottom surface and having a slotted channel for receiving the outer edge of the upper circular plate and thereby securing the tabletop to the safety cover and propane tank; and a waterproof tablecloth being draped over the top surface of the tabletop for fully covering the tabletop, safety cover, and propane tank.

2. The propane tank cover of claim 1, wherein the locking mechanism is a clamp for holding the lower locking collar in place.

3. The propane tank cover of claim 1, wherein both the fixed member and the rotatably hinged member have aligned cutouts when closed for allowing a pad lock to secure the lower locking collar around the lower portion of the protective cage.

4. A propane tank cover, which covers, protects, and locks a propane tank, the propane tank having a cylindrical body with an upper spherical cap, having a valve structure extending upwardly from the upper spherical cap, the valve structure having a side port, having a protective cage surrounding the valve structure, the protective cage having an upper edge and a lower portion, comprising:

a safety cover having an upper circular plate for covering the protective cage and resting over the upper edge, and a lower locking collar for fitting around the lower portion of the protective cage, the upper circular plate having an outer edge, the lower locking collar having a fixed member, a rotatably hinged member, and a locking mechanism;

a protective cap having a base portion and an L-shaped member, the base portion fits within the protective cage, while the L-shaped member attaches onto the base portion and extends over the side port for protecting the side port from leakage when not in use;

a tabletop for attaching to the upper circular plate of the safety cover, having a top surface and a bottom surface, the bottom surface having a centrally positioned track having a slotted channel; and a tablecloth for fully covering the tabletop, safety cover, and propane tank.

5. The propane tank cover of claim 4, wherein the rotatably hinged member has a first and a second end and is attached at the first end to the fixed member by a hinge.

6. The propane tank cover of claim 5, where the rotatably hinged member is securely closed against the fixed member at the second end by the locking mechanism.

7. The propane tank cover of claim 6, wherein a plurality of screws attached the centrally positioned track to the bottom surface of the tabletop.

8. The propane tank cover of claim 7, wherein the track extends outwardly from the bottom surface of the tabletop and the slotted channel receives the outer edge of the upper circular plate for securing the tabletop to the safety cover and propane tank.

9. The propane tank cover of claim 8, wherein the tablecloth is waterproof and draped over the top surface of the tabletop for fully covering the tabletop, safety cover, and propane tank.

10. The propane tank cover of claim 4, wherein the locking mechanism is a clamp for holding the lower locking collar in place.

11. The propane tank cover of claim 4, wherein both the fixed member and the rotatably hinged member have aligned cutouts when closed for allowing a pad lock to secure the lower locking collar around the lower portion of the protective cage.

* * * * *